US007979932B2

(12) United States Patent
Liang

(10) Patent No.: US 7,979,932 B2
(45) Date of Patent: Jul. 19, 2011

(54) OPERATING TABLE

(75) Inventor: Jyh-Wei Liang, Raleigh, NC (US)

(73) Assignee: Amtai Medical Equipment, Inc., Raleigh, NC (US)

( * ) Notice: Subject to any disclaimer, the term of this patent is extended or adjusted under 35 U.S.C. 154(b) by 143 days.

(21) Appl. No.: 12/466,752

(22) Filed: May 15, 2009

(65) Prior Publication Data

US 2010/0235995 A1 Sep. 23, 2010

(30) Foreign Application Priority Data

Mar. 17, 2009 (TW) ..... 98108659 A

(51) Int. Cl.
*A61G 7/10* (2006.01)

(52) U.S. Cl. ..... 5/613; 5/612; 5/617; 5/618

(58) Field of Classification Search ..... 5/607, 608, 5/610–614, 617, 618
See application file for complete search history.

(56) References Cited

U.S. PATENT DOCUMENTS

| | | | | |
|---|---|---|---|---|
| 677,181 | A * | 6/1901 | Dardano | 5/618 |
| 3,281,141 | A * | 10/1966 | Smiley et al. | 5/614 |
| 4,865,303 | A * | 9/1989 | Hall | 5/614 |
| 5,621,933 | A * | 4/1997 | Knapp et al. | 5/608 |
| 6,038,718 | A * | 3/2000 | Pennington et al. | 5/618 |
| 6,874,182 | B2 * | 4/2005 | L'Hegarat et al. | 5/612 |
| 7,073,222 | B1 * | 7/2006 | Skripps | 5/618 |

* cited by examiner

*Primary Examiner* — Michael Trettel
(74) *Attorney, Agent, or Firm* — Muncy, Giessler, Olds & Lowe, PLLC

(57) ABSTRACT

An operating table includes a base, a support post standing on the base, and a bed. The bed has a head section, a back section, a hip section and a foot section. The back section and the foot section respectively connect with ends of the hip section through pivot joints and are pivotable relative to the hip section upward and downward. The foot section has a rear section and a front section connecting with each other, and is pivotable either upward to an angle of less than 135 degree with respect to the hip section. The rear section is detachable separately, and an angle of the front section with respect to the hip section is adjustable via a pivot joint. The foot section can be shortened to support downward weight of the patient reliably. Moreover, a surgeon can adjust angles between the patient's legs and hip easily during the operation.

4 Claims, 5 Drawing Sheets

OPERATING TABLE

BACKGROUND OF THE INVENTION (a) Field of the Invention

The present invention relates to an operating table, and particularly to an operating table adapted for Endoscopic Nissen Fundoplication.

(b) Description of the Prior Art

Endoscopic surgery appliance is developed rapidly, and a variety of surgical operations using surgery knife are gradually replaced with Minimum Invasive Surgery, which decreases risk and discomfort of the surgical operations.

Endoscopic Nissen Fundoplication is such an example. Nissen 360 degree gastric fundus fully embedding surgery, which has been used for over forty years, is commonly deemed as the best operation in treatment for Gastro-Esophageal Reflux Disease (GERD). However, this surgery requires chest incision. Patients are usually inclined to be treated by medicine instead of this surgery, but the effect is unsatisfactory.

This situation is not changed until laparoscopic surgery is widely used. Patients are willing to admit this surgical operation to substitute medicine.

In FIG. 8, when an endoscopic Nissen Fundoplication is performed, a patient sits on a conventional operating table 10. Bandages 20 are provided on both side rails of the conventional operating table 10 to fix the patient's weight. Two additional foot supports 30 which cannot undergo large weight support the patient's feet. During the process of the operation, angles between his legs and hip are adjusted so as to relocate organs within the chest to reserve space for operation. The conventional operating table 10 cannot fully meet the need of relocating position of the patient's body. Occasionally, a fat patient may slide out of the conventional operating table 10 owing to unreliable fixation. At times the bandages 20 exert excessive weight upon a part of a patient's body, deteriorating blood recycle of a patient's anaesthetic legs, and therefore resulting in bedsore. Moreover, the surgeon sits or stands between the two legs of the patient. So the surgeon is often barred by a bottom base 101 of the conventional operating table 10, and cannot approach the operating part of the patient. In this case, the surgeon tends to feel fatigued, and can not ensure quality and procedure of the operation.

SUMMARY OF THE INVENTION

An object of the present invention is to provide an operating table with which downward weight of a patient on a specific surgical position is supported reliably and a surgeon easily adjusts angles between the patient's legs and hip during surgical operation.

Another object of the present invention is to provide an operating table with which a surgeon easily stands approaching to a patient's surgical part, and thereof relieves fatigue and discomfort of the surgeon and improves quality of the operation.

A further object of the present invention is to provide an operating table increasing a length of a bed thereof under continuous X ray examination.

The operating table comprises a base, a support post standing on the base and having variable length, and a bed. A connecting arm is formed on a top of the support post and supports the bed to move longitudinally. The bed comprises a head section, a back section, a hip section and a foot section, which are separable from each other. The back section and the foot section respectively connect with ends of the hip section through pivot joints, and are pivotable relative to the hip section upward and downward. The foot section is pivotable either upward to no less than 45 degree above the hip section or downward to no less than 45 degree below the hip section. The hip section connects with the connecting arm, and the connecting arm brings the hip section to be left inclined or right inclined, or rotate forward or rearward, whereby the bed is wholly movable with the hip section.

The foot section comprises a rear section and a front section connecting with each other. The rear section is detachable separately, and an angle of the front section with respect to the hip section is adjustable via a pivot joint.

The head section is detachable from the back section to be assembled on a rear of the foot section, whereby the bed is wholly set as a reverse position.

To enable a further understanding of the said objectives and the technological methods of the invention herein, the brief description of the drawings below is followed by the detailed description of the preferred embodiments.

DESCRIPTION OF THE PREFERRED EMBODIMENTS

Figure 1:
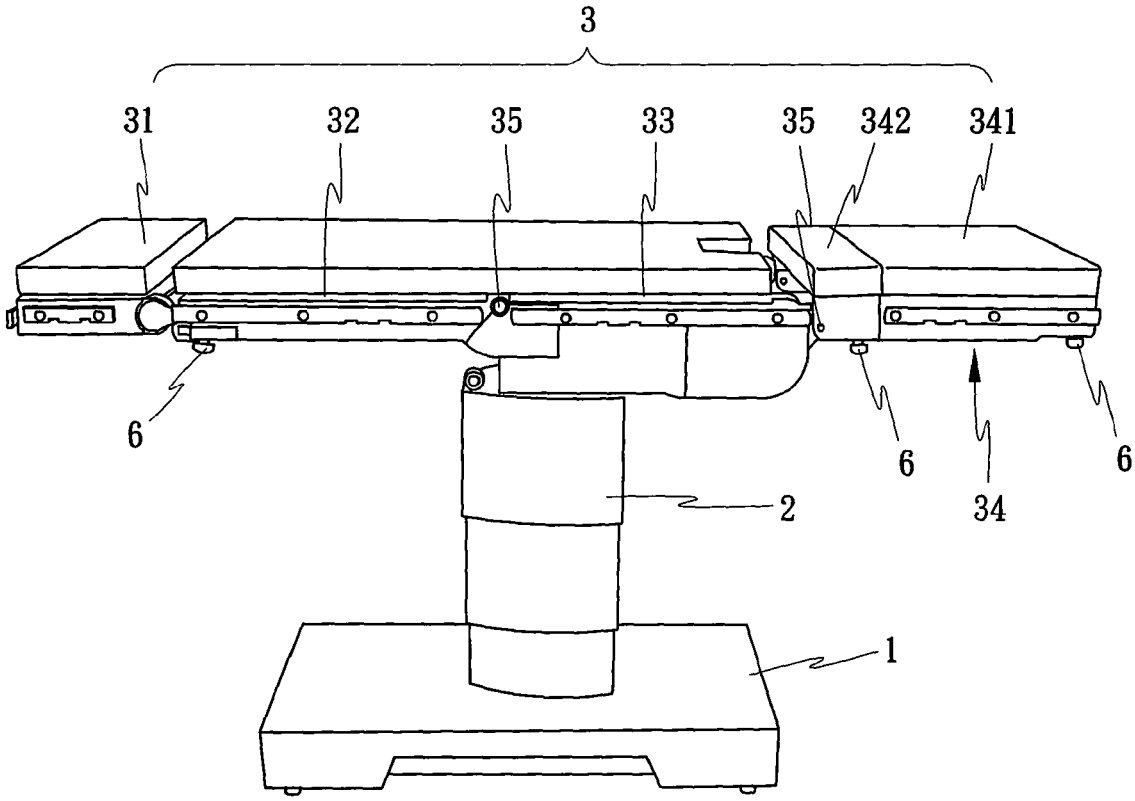
FIG. 1 is a perspective view of an operating table of the present invention.
Figure 2:
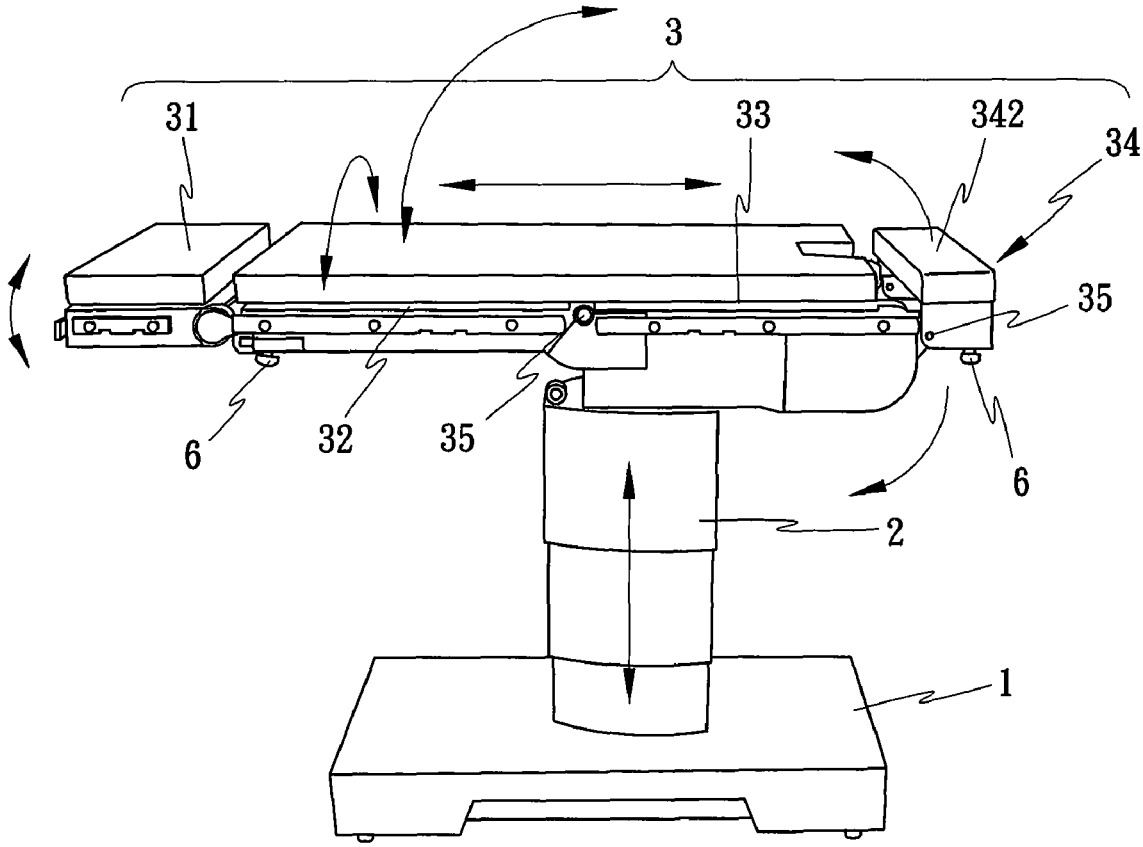
FIG. 2 is another perspective view of the operating table, wherein a rear section of a foot section thereof is removed.

With reference to FIGS. 1 and 2, an operating table according to the present invention comprises a base 1, a support post 2 standing on the base 1, a bed 3 on a top of the support post 2. A connecting arm 21 (see FIG. 6) supports the bed 3, and the bed 3 is capable of moving longitudinally. The connecting arm 21 has a pair of rotating shafts (not labeled) orthogonal to each other, forming a gimbal structure. Rolling wheels (not labeled) and brakes (not labeled) are provided on corners of a bottom of the base 1 for moving the operating table or fixing the operating table onto the ground. The support post 2 has variable length for being elevated or lowered as desired. The base 1 and the support post 2 have functions as well known to the skilled person in the art, and description thereof are omitted herein.

Figure 3:
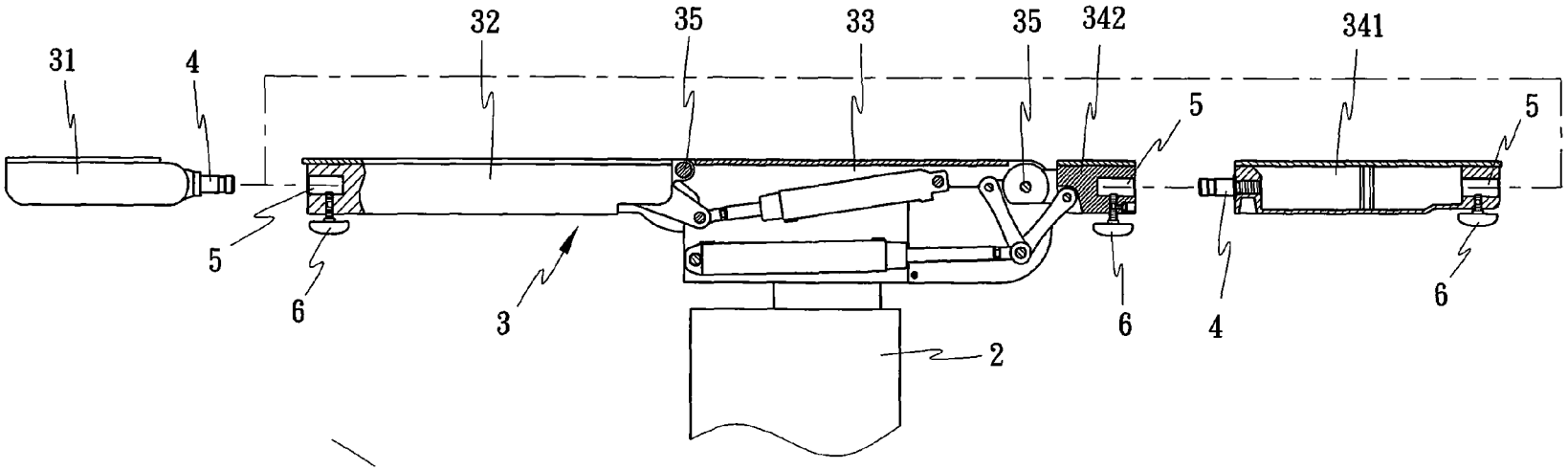
FIG. 3 is an exploded view of a bed of the operating table.

The bed 3 comprises a plurality of sections separable from each other each other, for example, a head section 31, a back section 32, a hip section 33 and a foot section 34. The head section 31 is detachable from the back section 32, and is then assembled on a rear of the foot section 34 (see FIG. 3). The bed 3 can be wholly set as a reverse position.

The back section 32 and the foot section 34 are respectively linked to the hip section 33 through pivot joints 35. Correspondingly, the back section 32 and the foot section 34 are able to pivot relative to the hip section 33 through the pivot joints 35. The hip section 33 connects with the connecting arm 21 on the top of the support post 2. Not only the hip section 33 can move in the longitudinal direction of the bed 3, but also the gimbal structure of the connecting arm 21 can bring the hip section 33 to be left inclined or right inclined, or rotate forward or rearward when the connecting arm 21 is activated by an oil hydraulic cylinder 24 (see FIG. 6). The bed 3 can be wholly moves due to the hip section 33.

Figure 5:
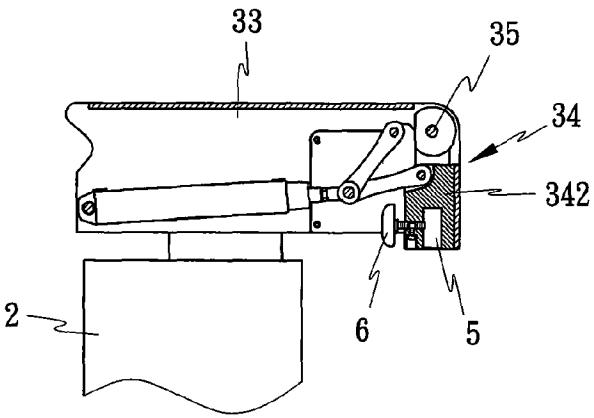
FIG. 5 schematically shows the foot section of the operating table upon another body position.

The foot section 34 comprises a rear section 341 and a front section 342 connecting with each other in such a way that the rear section 341 is detachable separately, as shown in FIG. 2. The front section 342 may adjust the angle with respect to the hip section 33 via a pivot joint 35. The front section 342 is either pivotable upward to no less than 45 degree above the hip section 33 (see FIG. 4) or downward to no less than 45 degree below the hip section 33 (see FIG. 5).

Figure 4:
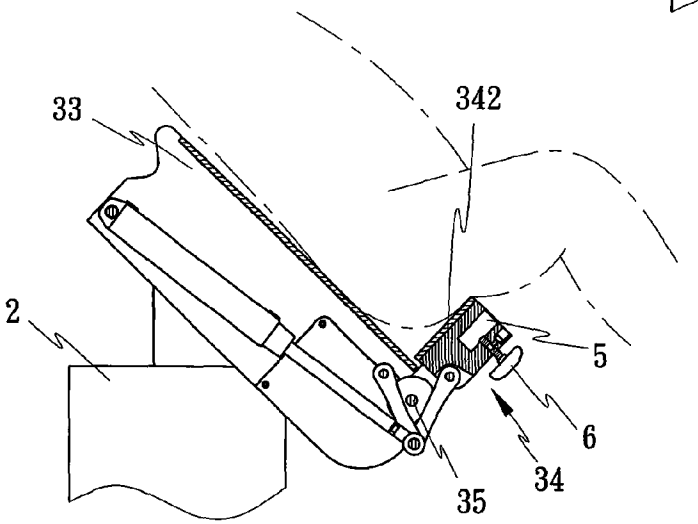
FIG. 4 schematically shows the foot section of the operating table upon a patient's body position when an endoscopic Nissen Fundoplication is performed.

The bed 3 can vary in multiple sorts of combination. Especially for endoscopic Nissen Fundoplication, the operating table of the present invention supports downward weight of a patient on a specific surgical position. In this case, the rear section 341 of the foot section 34 is detached, and only the front section 342 of the foot section 34 is remained to connect with the hip section 33. As a result, the foot section 34 is shortened. Then the front section 342 turns upward for supporting a patient who sits with the hip. So the downward weight of the patient is supported reliably, as shown in FIG. 4. During the operation, the surgeon is allowed to easily adjust angles between the patient's legs and hip to facilitate the endoscopic operation.

Figure 6:
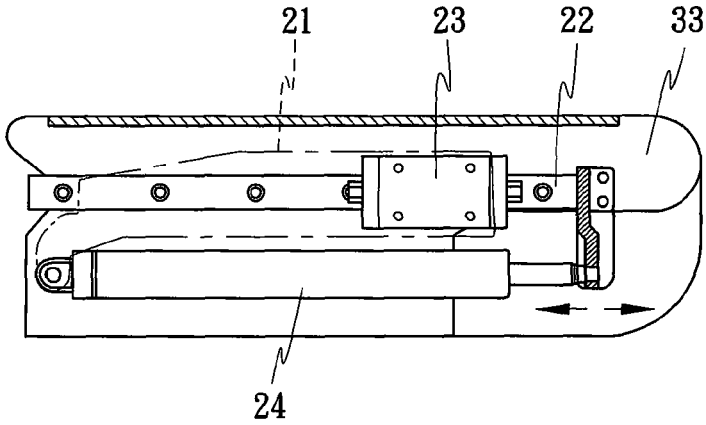
FIG. 6 is a partially cross-sectional view of the operating table, wherein the operating table is assembled.

Further referring to FIG. 6, rails 22 are respectively formed on inward sides of both lateral sides of the hip section 33. Sliding blocks 23 are formed on outward sides of the connecting arm 21. The sliding blocks 23 move along the rails 22, thereby the connecting arm 21 is assembled with and is movable relative to the hip section 33. An oil hydraulic cylinder 24 is provided on the connecting arm 21 to pull the hip section 33 to move. The hip section 33 moves along the rails 22 and in longitudinal direction of the bed 3. The surgical part of the patient can extend out of the base 1. Thus, the surgeon easily stands approaching to surgical part of the patient, and therefore relieves fatigue and discomfort of the legs. This makes the surgeon be able to pay more attention to the operation and improves quality of the operation.

Figure 7:
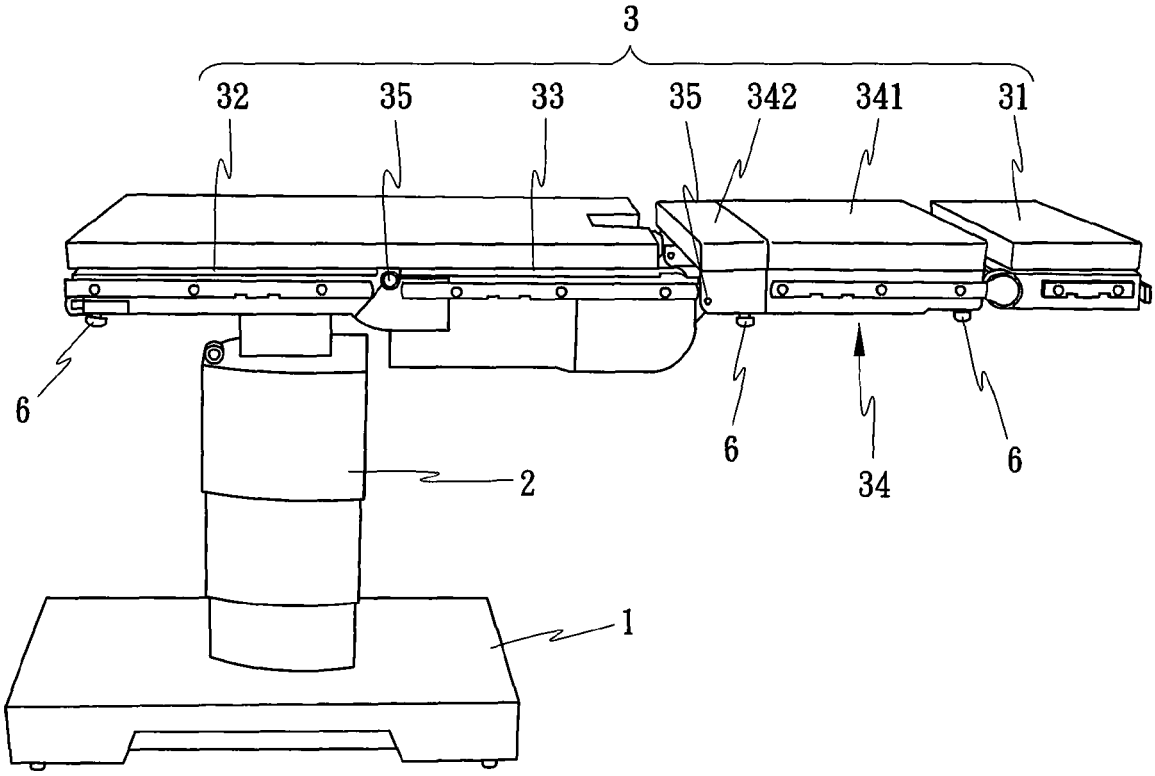
FIG. 7 is a schematically perspective view of the operating table with the maximum offset.
Figure 8:
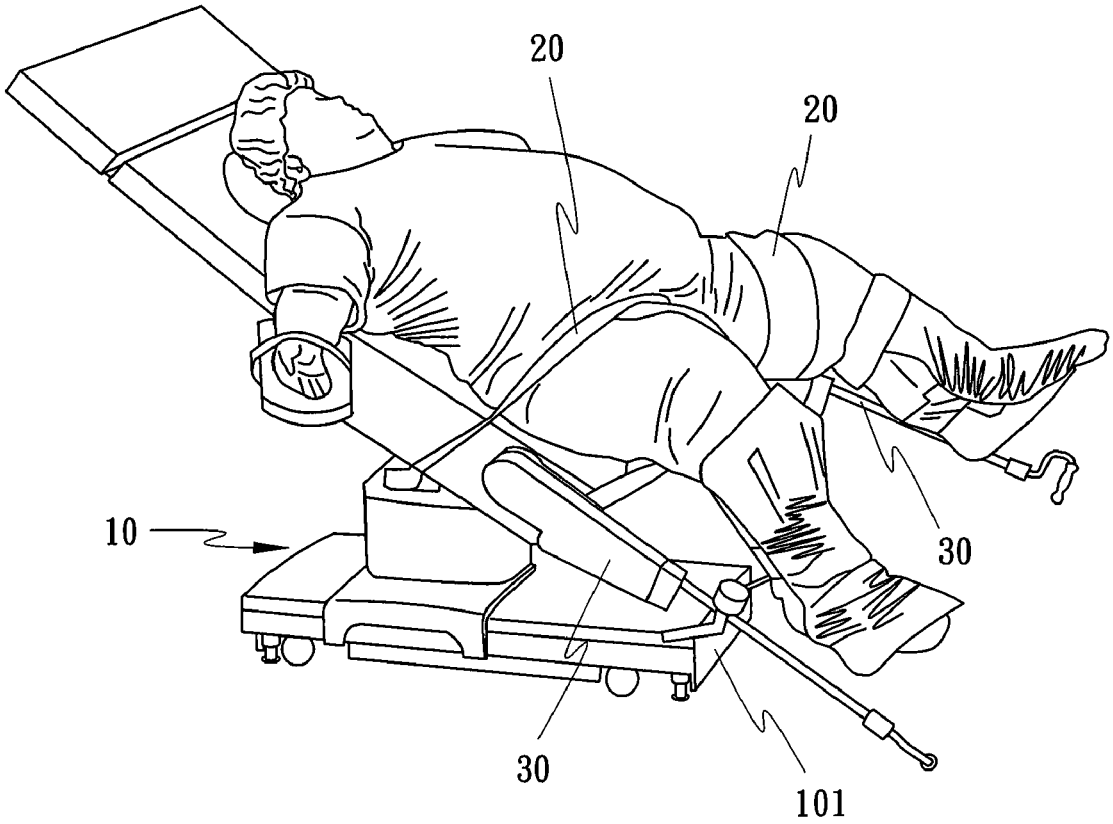
Fig. 8 (Prior Art)
FIG. 8 schematically shows a conventional operating table in use.

Besides the endoscopic Nissen Fundoplication, the operating table of the present invention is suitable for other operations. For instance, the head section 31 is detached from the back section 32, and is assembled to a rear of the rear section 341 or a rear of the front section 342. In this case, the operating table is set as a reverse position. The bed 3 is further movable in longitudinal direction, increasing the overall length in the scope of continuous X ray examination (see FIG. 7). By this means, the X ray photograph is taken more easily without obstruction of the base 1.

The head section 31 and the rear section 341 of the foot section 34 may be alternatively detached from or combined with the back section 32 and the front section 342 of the foot section 34. A plug post 4 is adapted to connect the head section 31 with the back section 32. A plug hole 5 is defined in the back section 32 for corresponding to the plug post 4. A pin 6 limits the plug post 4 in the plug hole 5 when the plug post 4 is inserted into the plug hole 5, whereby the head section 31 and the back section 32 may be retained firmly or be easily disassembled. Similarly, a plug post 4 and a plug hole 5 are provided on ends of the rear section 341 of the foot section 34, and a plug hole 5 is defined in an end of the front section 342 of the foot section 34. Thus, the bed 3 can be separated or combined as desired.

The bed 3 is connected with the connecting arm 21 by the hip section 33 in such a way that the connecting arm 21 can bring the bed 3 to be left inclined or right inclined, or rotate forward or rearward. It is mainly because the connecting arm 21 has the gimbal structure with a pair of rotating shafts orthogonal to each other. When the rotating shafts are driven by individual oil hydraulic cylinders, the rotating shafts mutually form various changed angles therebetween. Correspondingly, the bed 3 forms various changed angles in respect to the connecting arm 21.

It is of course to be understood that the invention may be embodied in other forms without departing from the spirit thereof. Thus, the present examples and embodiments are to be considered in all respects as illustrative and not restrictive, and the invention is not to be limited to the details given herein.

What is claimed is:

1. An operating table comprising:

a base having rolling wheels and brakes on a bottom thereof;

a support post standing on the base and having variable length, a connecting arm being formed on the support post; and a bed being supported by the connecting arm to be movable longitudinally, and comprising a head section, a back section, a hip section and a foot section, the back section and the foot section respectively connecting with ends of the hip section through pivot joints and being pivotable relative to the hip section upward and downward, the foot section being pivotable either upward to no less than 45 degree above the hip section or downward to no less than 45 degree below the hip section, the hip section connecting with the connecting arm, the connecting arm bringing the hip section to be left inclined or right inclined, or to rotate forward or rearward, whereby the bed is wholly movable with the hip section;

wherein the foot section comprises a rear section and a front section connecting with each other, the rear section being detachable separately, an angle of the front section with respect to the hip section being adjustable via a pivot joint.

2. The operating table as claimed in claim 1, wherein the head section is detachable from the back section to be assembled on a rear of the foot section, whereby the bed is wholly set as a reverse position.

3. The operating table as claimed in claim 1, wherein the head section is assembled on a rear of the rear section of the foot section, whereby the bed is wholly set as a reverse position.

4. The operating table as claimed in claim 1, wherein the head section is assembled on a rear of the front section of the foot section, whereby the bed is wholly set as a reverse position.

* * * * *